United States Patent [19]

Keller, Jr.

[11] 4,248,698

[45] Feb. 3, 1981

[54] COAL RECOVERY PROCESS

[75] Inventor: Douglas V. Keller, Jr., Lafayette, N.Y.

[73] Assignee: Otisca Industries Limited, Syracuse, N.Y.

[21] Appl. No.: 82,131

[22] Filed: Oct. 5, 1979

Related U.S. Application Data

[63] Continuation-in-part of Ser. No. 958,749, Nov. 8, 1978, abandoned.

[51] Int. Cl.[3] ..... B03D 3/06

[52] U.S. Cl. ..... 209/5; 241/16; 241/24; 44/1 SR

[58] Field of Search ..... 241/15, 16, 20, 24; 209/5, 172, 49; 210/54; 23/313 R, 314; 44/1 SR; 201/17; 208/8

[56] References Cited

U.S. PATENT DOCUMENTS

| | | | |
|---|---|---|---|
| 32,012 | 4/1861 | Storer | 44/4 |
| 2,764,359 | 9/1956 | Szegvari | 241/15 |
| 2,784,468 | 3/1957 | Booth et al. | 164/5 |
| 3,268,071 | 8/1966 | Puddington et al. | 209/5 |
| 3,394,893 | 7/1968 | Moss et al. | 241/20 |
| 3,637,464 | 1/1972 | Walsh et al. | 201/6 |
| 3,919,080 | 11/1975 | Stauter | 209/167 |
| 3,960,513 | 6/1976 | Agarwal et al. | 44/1 SR |
| 4,022,588 | 5/1977 | Dessau | 44/1 R |
| 4,033,729 | 7/1977 | Capes et al. | 44/1 A |
| 4,076,505 | 2/1978 | Dessau | 44/1 SR |
| 4,080,176 | 3/1978 | Verschour | 44/1 R |

*Primary Examiner*—Ralph J. Hill

*Attorney, Agent, or Firm*—LeBlanc, Nolan, Shur & Nies

[57] ABSTRACT

Agglomeration type processes for recovering coal in which calcium oxide is employed to bring about an effective separation of pyritic sulfur from the coal.

14 Claims, 1 Drawing Figure

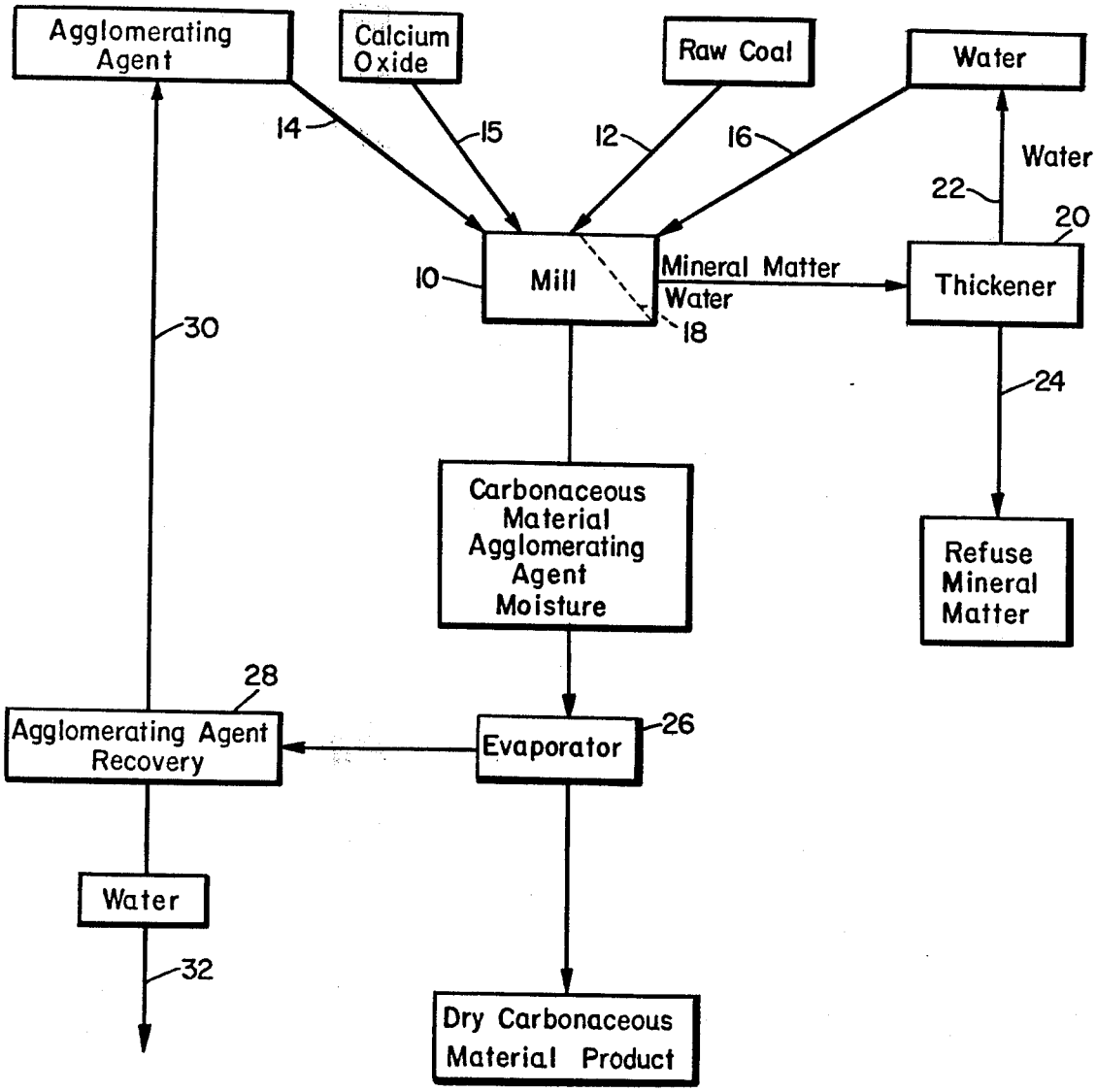
Agglomerating Agent
Calcium Oxide
Raw Coal
Water
14
15
12
16
Water
22
20
10
Mill
Mineral Matter
Water
18
Thickener
30
24
Carbonaceous Material Agglomerating Agent Moisture
Refuse Mineral Matter
28
Agglomerating Agent Recovery
Evaporator
26
Water
32
Dry Carbonaceous Material Product

COAL RECOVERY PROCESS

RELATION TO OTHER APPLICATIONS

This application is a continuation-in-part of application Ser. No. 958,749 filed Nov. 8, 1978, now abandoned.

BACKGROUND, BRIEF DESCRIPTION, AND OBJECTS OF THE INVENTION AND DISCUSSION OF THE PRIOR ART

The present invention relates to novel, improved coal cleaning processes of the agglomeration type for producing coal having a low pyritic sulfur content.

In some instances, the steps of my novel process, the materials used in carrying it out, and the equipment employed may be as described in pending U.S. application Ser. No. 561,168 which was filed Mar. 24, 1975, and which is assigned to the assignee of this application. U.S. application Ser. No. 561,168 (which has since matured into U.S. Pat. No. 4,173,530 dated Nov. 6, 1979) is, therefore, hereby incorporated by reference herein.

Certain terms used herein are defined as follows:

Raw coal—a composite of coal, pyritic sulfur, and "mineral matter" (the quoted term is used herein for the sake of convenience to include other inorganic material associated with coal). In general raw coal will constitute the feedstock for a process designed to remove pyritic sulfur and mineral matter therefrom. The raw coal may be as mined with or without having been subjected to preliminary preparation; or it may be the black water from a hydrobeneficiation plant or the culm from a sludge pond, etc.

Product coal—the phase generated in and recovered from a specified cleaning process and consisting of particles which are up to 99% by weight or more coal.

Copending U.S. application which has since matured into U.S. Pat. No. 4,186,886 dated Feb. 5, 1980, Ser. No. 933,845 filed Aug. 15, 1978, and assigned to the assignee of the present application, discloses a novel process for cleaning coal which involves the steps of:

(a) comminuting raw coal in aqueous slurry and in the presence of a fluorochlorocarbon agglomerant with respect to which the coal is hydrophobic to generate to generate two phases, one composed of particles of mineral matter and the other of particles of coal having freshly exposed surfaces;

(b) mechanically forcing the particles of coal together in the slurry and in the presence of the fluorochlorocarbon to agglomerate the particles of coal and to eject water and mineral matter from the agglomerates into the aqueous phase of the slurry; and (c) kneading or working the agglomerates to expel additional mineral matter and water therefrom.

This benefication process produces a product coal phase composed of dense agglomerants and an aqueous carrier-mineral matter phase.

The agglomeration process just described is capable of reducing the mineral matter contents of coals to levels well below even those which can be attained by employing the state of the art process disclosed in copending U.S. application Ser. No. 561,168. However, the agglomeration process is not as effective as might be desired in removing pyritic sulfur from the coal being cleaned. This is advantageous in certain cases because subsequent combustion of the coal results in the conversion of the pyritic sulfur to sulfur dioxide, creating an atmospheric pollution problem.

One primary object of the present invention resides in the provision of novel, improved coal cleaning processes which employ an agglomeration technique and which also have the capability of reducing the pyritic sulfur content of the product coal to an extremely low level.

In general this and other important objects of the invention are achieved by adding calcium oxide in either anhydrous or hydrated form to the coal being cleaned. For reasons which are not fully understood, the calcium oxide is effective in the presence of the freshly exposed, unoxidized surfaces generated in comminuting the raw coal to cause pyritic materials to remain dispersed in the aqueous phase of the slurry without adversely affecting the coalescence of the product coal. That is, the calcium oxide apparently inhibits the ability of the pyritic material to agglomerate along with product coal without effecting the agglomeration of the latter.

The process of the present invention as just described is capable of reducing the pyritic sulfur content of coal to a level which has heretofore been equalled only by non-competitive, chemical processes of coal treatment such as oxidation, gasification, and liquefaction. Pyritic sulfur contents of only a few one-hundreths of one percent have consistently been obtained.

It has heretofore been proposed in U.S. Pat. No. 3,919,080 issued Nov. 11, 1975, to Stauter, for example, that sodium sulfite be used as a pyrite depressant in coal recovery processes. This approach is inferior to the novel process described herein because the Stauter depressant increases the sodium ion concentration of the coal. As a result, the fusion point of the ash formed when the coal is burned is lowered to a level where the corrosion problems the ash causes become critical.

Furthermore, the reductions in pyrite content that can be obtained by processes using sodium sulfite as a pyritic sulfur depressant are much smaller than those I am able to achieve.

A coal upgrading process which appears at first blush to resemble mine in that lime is employed as an additive is disclosed in U.S. Pat. No. 3,637,464 issued Jan. 25, 1972, to Walsh et al. Closer inspection, howver, reveals that there is actually little similarity between the two processes. In the Walsh et al process the lime is added to an aqueous dispersion of coal after the coal has been ground to reduce its particle size. As a result, the calcium oxide is exposed only to oxidized coal particle surfaces; and it consequently cannot interact with the coal in the manner I have found essential for the minimization of pyritic sulfur in the product coal (as discussed above, this goal requires that the calcium oxide interact with freshly exposed surfaces of the raw coal particles).

Furthermore, the process disclosed in the Walsh et al patent necessarily results in a film of the oil used as a bridging agent being left on the surfaces of the product coal; and high temperatures are employed to recover that oil which is not left on the coal. This can make the process uneconomical in many instances due to the loss of the unrecovered bridging agent and the energy consumed in recovering that oil which is not left on the coal.

The foregoing are deficiencies which are remedied by my process. The latter allows the use of materials which can be recovered in essentially quantitative amounts from the product coal, and only a fraction as much energy is needed to recover the process material.

Another coal beneficiation process in which limestone can be employed as an additive is described in U.S. Pat. No. 4,033,729 issued July 5, 1977, to Capes et al. In that case, however, the additive is not employed in the manner or for the purposes I have in mind. Instead, it is used to promote the coalescence of particulate inorganic minerals in a reverse agglomeration process.

U.S. Pat. No. 4,080,176 issued Mar. 21, 1978, to Verschuur discloses a coal beneficiation process which somewhat resembles mine in that calcium hydroxide can be used as an aid to desulfurization. Otherwise, the process is quite different. It is carried out at high temperatures (preferably above 250° C. (482° F.)) and under very high pressure (100 atmospheres is mentioned); and the calcium hydroxide is employed only as a solubilization aid for insoluble sulfur compounds in the coal being processed, not to effect a separation of pyritic sulfur particles from product coal.

Lime has also been used as a settling agent in flotation processes and to adjust the pH of aqueous slurry feedstocks as shown, respectively, by U.S. Pat. Nos. 2,784,468 issued Mar. 12, 1957, to Booth et al. and 3,394,893 issued July 30, 1968, to Moss et al. Again, however, the lime is used in a manner and for a purpose which is quite different from that I contemplate in that there is no interaction between the additive and unoxidized coal particle surfaces.

As discussed above, the presence of sodium ions in coal is undesirable because of the corrosion problems this creates. In contrast, the presence of calcium ions can be a decided benefit. When the coal is burned, the calcium ions react with sulfur remaining in coal, forming a precipitate that can be readily removed from the combustion products. Thus, the presence of calcium ions in the coal produced by my novel process actually facilitates the removal of pollutants from the combustion products.

There is also evidence that calcium increases the hydrogasification and steam gasification reactivities of coal. My novel process has the additional advantage in this respect that the calcium is present in a relation to the coal which promotes the catalytic activity of the metal in such reactions.

One primary object of my invention has been described above.

Another important and primary object of the invention is the provision of novel, improved, coal cleaning processes of the character described in the previously set forth primary object in which the reduction of pyritic sulfur can be inexpensively affected.

Yet another important and primary object of the invention resides in the provision of coal cleaning processes in accord with the preceding objects in which a calcium oxide is employed to promote the reduction of pyritic sulfur.

Still another important and related object of the invention resides in the provision of a process in accord with the preceding object in which, in the course of the process, the calcium oxide is associated with the product coal in a manner which increases the hydrogasification and steam gasification reactivities of said coal.

Other important objects and features and additional advantages of my invention will become apparent from the appended claims and as the ensuing detailed description and discussion proceeds in conjunction with the accompanying drawing.

BRIEF DESCRIPTION OF THE DRAWING

The single FIGURE of the drawing is a flow diagram of a plant for producing coal having a low pyritic sulfur content in accord with the principles of the present invention.

DETAILED DESCRIPTION OF THE INVENTION

Referring now to the drawing, the separation of coal from the pyritic sulfur and other mineral matter associated therewith and the subsequent agglomeration of the coal particles is carried out in a mill 10 which may be, for example: an attritor (see, for example, U.S. Pat. No. 2,764,359 issued Sept. 25, 1956, to Szegvari); or a ball, beater, buhr, cage, Chilean, colloid, disc, disintegrating, hammer, pebble, pendelum, pin, Raymond, or rod mill.

The foregoing can be accomplished at ambient temperature and pressure.

Mill 10 reduces the size of the material fed to it, thereby liberating the product coal from the pyritic sulfur and other mineral matter to which it is bound and exposing fresh surfaces on the coal particles. The mill also provides mechanical forces which jam the coal particles into agglomerates of the wanted character and which eject mineral matter and water from the agglomerates. In addition it generates forces which knead or work the agglomerates to expel additional mineral matter and water therefrom.

Raw coal (i.e., the coal to be cleaned), an agglomerant, and hydrated or anhydrous calcium oxide (hereinafter sometimes referred to as an "additive") are introduced into the mill through transfer devices identified generally by reference characters 12, 14, and 15. Such water as may be necessary is introduced into mill 10 through conduit 16.

The minimum of agglomerant I employ is that necessary for an efficient agglomeration of the particles of product coal to be effected. Two to 10 percent by weight of the agglomerant based on the weight of the aqueous carrier-raw coal-agglomerant-additive system is necessary for that purpose, depending upon the character of the agglomerant and the nature of the coal.

The ratio of agglomerant to coal is maintained in the range of 0.13 to 2.5 by weight with a weight ratio around 0.6 being preferred in typical applications of my invention. At lower ratios the amount of agglomerant is not sufficient to effect the wanted, complete agglomeration of the product coal; at ratios higher than that specified, efficient rejection of the particles of mineral matter may not be effected because the excess agglomerant forms a film through which substantial amounts of the particles may not have sufficient energy to escape; and they are consequently unable to agglomerate.

I consider it essential that a minimum of 70 percent of water based on the weight of the raw coal-agglomerant-additive-aqueous liquid system be maintained in mill 10. Lower amounts do not provide a sufficiently large body of liquid to hold the pyritic sulfur and other mineral matter in suspension, which is a requisite of my process.

Often, the water associated with the raw coal will itself meet the above-stated requirement in which case it may not be necessary to introduce additional water. One example of the foregoing is where the feedstock is pumped to the process from a slurry pond.

The maximum amount of water and agglomerant that can be tolerated in mill 10 is that at which the comminution of the solids in the mill becomes inefficient. Depending upon the type of mill being employed, up to 98 percent of water and agglomerant combined may be employed based upon the weight of the raw coal.

I may employ certain fluorochloro derivatives of methane and ethane as agglomerants.

At least 24 such derivatives have been reported in the literature. Of these, 16 are of no interest because their boiling points are so low that the process would have to be refrigerated, which is obviously impractical, or so high that the cost of recovering them from the agglomerates would be prohibitive.

The fluorochlorocarbon derivatives which I consider suitable because coal is hydrophobic with respect to them and because of their boiling points (ca. 40°–159° F.) and other physical characteristics (low viscosity, latent heat of vaporization, and surface tension and lack of tendency to form azeotropes) are:

1-Chloro-2,2,2-trifluoroethane
1,1-Dichloro-2,2,2-trifluoroethane
Dichlorofluoromethane
1-Chloro-2-fluoroethane
1,1,2-Trichloro-1,2,2-trifluoroethane
1,1-Dichloro-1,2,2,2-tetrafluoroethane
Trichlorofluoromethane Mixtures of the foregoing fluorochlorocarbons can also be employed.

Of the listed compounds, all but the last three are at the present time probably too expensive to be practical from an economic viewpoint. And, of the latter, 1,1,2-trichloro-1,2,2-trifluoroethane and trichlorofluoromethane are preferred because of their optimum physical properties, chemical activity, and relatively low cost.

Conventional agglomerants can also be employed in my novel process although fluorochlorocarbon agglomerants are preferred because of the advantages they have (see U.S. application Ser. No. 933,845). Usable conventional agglomerants include petroleum distillates; nitrobenzenes; petroleum solvents such as those of the Varsol type; kerosene; lubricating, fuel, and residual oils; chlorinated biphenyls; liquid hydrocarbons such as pentane; and mixtures of two or more of the foregoing.

From 0.13 to 0.53 percent by weight of calcium oxide or calcium hydroxide (calculated as CaO) based on the weight of the water in the mill or other process equipment is employed.

The stated minimum exceeds the amount of calcium oxide which is soluble in water (1.87 grams/liter at standard conditions), guaranteeing that an excess of the compound over that needed to produce a saturated solution will exist in the water-coal-agglomerant-additive system. This maintenance of a calcium oxide excess has been found by actual test to be necessary to the effective elimination of pyritic sulfur, apparently because an excess of $Ca(OH)_2$ is a requisite to effective pyrite rejection.

This novel utilization of a system containing a calcium oxide in excess of that amount which produces a saturated solution as a mechanism to reject pyritic sulfur clearly differentiates my novel process from these exemplified by the above-cited Walsh patent. In the latter calcium oxide is used—in amounts below saturation—as a pH modifier; and other compounds are used as pyrite depressors.

If the amount of calcium oxide used is not sufficient to provide or maintain this excess, the additive will not effect the wanted decrease in pyrite content of the product coal to any significant extent. Amounts of a calcium oxide above the stated limit may cause product coal to remain dispersed in the aqueous phase of the slurry to an extent that results in a significant BTU loss.

Either anhydrous or hydrated calcium oxide can be used although the latter is preferred in general from the viewpoints of economics and efficacy.

One typical charge I have successfully employed in a small scale batch operation consists, based on the weight of the system, of 15% raw coal, 9% 1,1,2-trichloro-1,2,2-trifluoroethane agglomerant, 75.5% water, and 0.5% hydrated calcium oxide (calculated as CaO).

The residence time in the mill is that necessary to effect a sufficient reduction in particle size to separate the raw coal into particles which are, mainly, product coal, pyritic sulfur, and other mineral matter; to generate unoxidized surfaces on those particles; and to effect subsequent agglomeration of the product coal particles. Efficient separation of the coal from the associated pyritic sulfur and other mineral matter requires that the raw coal be reduced to a top size of at least 50 microns. In a ball mill this will typically require a grinding time of two hours for a representative coal. By employing other types of mills this time can be cut to minutes, although this may be at the expense of higher expenditures of energy, a reduction in the permissible concentration of solids, and/or other trade-offs that may decrease the significance of the reduction in process time.

I consider it important, in conjunction with the foregoing, that the raw coal be free of large amounts of ultrafines. The agglomeration of the product coal particles involves surface active phenomena which operate efficiently (if at all) only on freshly exposed surfaces of the predominantly product coals particles. As coal oxidize rapidly in air, this means that those surfaces must be generated in the controlled environment of the mill. The fracturing of the coal particles to the extent necessary to generate adequate fresh surfaces cannot be accomplished with even prolonged periods of milling if large amounts of ultrafine coal particles are present in the raw coal.

Furthermore, as discussed above, the wanted reporting of the pyritic sulfur to the aqueous phase of the pump or slurry also requires extensive generation of fresh surfaces on the particles which are predominantly pyritic sulfur.

And it may be important that the particles of mineral matter be similarly fractured in a controlled environment.

The requirement that only a limited proportion of ultrafine particles be present in the feedstock dictates that the raw coal supplied to mill 10 have a minimum top size on the order of about 60 mesh×0 Tyler (0.25 mm×0).

It is preferred that the calcium oxide be dosed or metered to the slurry over the period of residence in the mill in batch-type operations. That method of adding the oxide results in there being a substantially lower amount of pyrite in the product coal than can be obtained by a batch-type addition of the calcium oxide to the slurry at the beginning of, or during, the beneficiation step of the process.

I also prefer that the water or aqueous portion of the slurry be changed after grinding periods of 15–45 minutes or that a discharge of refuse laden water and concomitant replacement of that phase with fresh water (with an excess of lime or other form of CaO) be effected in accord with conventional milling practice. If the latter approach is employed, a supply and discharge rate of approximately 100–120% per hour based on the volume of the aqueous carrier will typically be employed where optimum separation of mineral matter is wanted as this results in a maximum reduction of mineral matter content. Where a less than optimum separation of mineral matter is acceptable, this rate can be reduced.

It will be obvious to those skilled in the relevant arts that the raw coal and the agglomerant can be metered to the mill along with the water and the additive and the products of the process continuously removed, making it possible to carry out the process in a continuous (as opposed to batch-type) manner.

In operating in the continuous manner just described the water, coal, and agglomerant, as well as the CaO, are maintained in the mill or other process equipment in amounts which will result in the concentration of those constituents being within the limits identified above.

The aqueous carrier, product coal agglomerates, pyritic sulfur, and other mineral matter are discharged from mill 10 through a schematically illustrated separator 18. This is typically a sieve bend, and it results in the mineral matter and water being separated from the product coal agglomerates. It directs the water and mineral matter rejects to a conventional thickener 20 as described, for example, in Taggart, HANDBOOK OF MINERAL DRESSING, John Wiley & Sons, Inc., New York, N.Y., 1927, pp. 15-04–15-26, hereby incorporated herein by reference. Here the pyritic sulfur and other mineral matter are separated from the water. The water may be recycled as indicated by arrow 22, and the mineral matter may be transferred to a refuse heap as indicated by arrow 24.

Traces of the agglomerant may be carried from the slurry with the mineral matter laden, aqueous phase in replacing that phase with fresh aqueous liquid. The agglomerant can be easily recovered in a conventional absorber in circumstances where recovery is economically justified.

In applications of the invention using fluorochlorocarbon or other recoverable agglomerants, the product coal agglomerates separated from the mineral matter and water by the sieve bend or other separator 18 with their accompanying burdens of additive and moisture are transferred to an evaporator 26 where at least the agglomerant is stripped from the agglomerates. Moisture associated therewith may also be stripped from the coal in evaporator 26. However, it is not in every case necessary that all, or even any, of this moisture be removed; and it is an important feature of my invention that an essentially quantitative (99% plus) recovery of agglomerant can be made without removing the water.

Suitable evaporators are described in U.S. application Ser. No. 561,168.

Mechanical removal of liquid can be employed in association with evaporator 26 to reduce the load on and cost of operating the latter in those instances where the moisture content of the coal is high enough to warrant. Simply by passing a typical agglomerant through the nip between two conventional wringer rolls, for example, the moisture content of the agglomerate can be reduced to on the order of 10% by weight. In general, however, mechanical dewatering will not be employed as the moisture content of the agglomerates typically does not exceed 10–25 weight (wt) percent.

The agglomerant and any moisture recovered from the evaporator therewith may be transferred to a recovery unit 28 where the water and additive are separated.

The agglomerant is recycled as shown by arrow 30, and the water (arrow 32) may also be recycled.

The examples which follow describe representative tests which illustrate various facets of my novel coal cleaning processes.

EXAMPLE I

To demonstrate the outstanding capability my novel process has for separating pyritic sulfur from coal, it was employed to clean coal from the Central Ohio Meigs No. 9 seam. This coal has a high percentage of pyritic sulfur, much of which is present in the form of ultrafine particles.

One liter of water was mixed with one hundred grams of 30 mesh ×0 raw coal and thirty milliliters of 1,1,2-trichloro-1,2,2-trifluoroethane agglomerant in a jar mill containing burundum grinding media having a 2 cm outer diameter. The system was sealed and rotated for a period of one hour.

Two grams of CaO were slurried in 120 ml of water to form an aqueous medium containing a saturated calcium solution and an excess of a calcium oxide compound. This was metered to the mill at the rate of about 1 ml/minute throughout the period for which the mill was operated.

At the end of the one hour period the agglomerated coal found in the mill was separated from the water-mineral matter phase by passing the entire mix through a 5 mesh sieve. The coal agglomerates were returned to the mill with clean water, and the cycle was repeated until the water phase existing after milling was essentially free of mineral matter.

The resulting agglomerates of clean coal were between 0.5 and 3 cm in diameter. The agglomerates were dried and submitted to chamical analysis.

To provide a basis for comparison, the foregoing procedure was duplicated, omitting the calcium oxide. Also, to provide a further basis for comparison, raw coal of the same origin was cleaned using the bench test, gravity separation process described in U.S. application Ser. No. 561,168 with trichlorofluoromethane being employed as the parting liquid.

Data obtained from representative tests are tabulated below. All data are on a dry basis, and all percentages except for BTU yield are based on weight.

TABLE 1

| Material: | Raw Coal | Product Coal A | Product Coal B | Product Coal C |
|---|---|---|---|---|
| Size Consist | ⅜ in. × 0 | 60 mesh × 0 | Fine | Fine |
| Percentage: | | | | |
| Ash | 22.83 | 8.08 | 6.87 | 2.58 |
| Pyritic Sulfur | 3.26 | 0.85 | 3.01 | 0.07 |
| Lb/M BTU:[1] | | | | |
| Ash | 21.32 | 6.13 | 5.14 | 1.84 |
| Pyritic Sulfur | 3.06 | 0.65 | 2.25 | 0.05 |
| Reduction %: | | | | |
| Ash | — | 83.9 | 80.5 | 94.0 |
| Pyritic Sulfur | — | 89.2 | 40.3 | 98.9 |
| BTU/Lb | 10,707 | 13,173 | 13,372 | 13,984 |

TABLE 1-continued

| Material: | Raw Coal | Product Coal A | Product Coal B | Product Coal C |
|---|---|---|---|---|
| BTU Yield % | — | 50.2 | 99 | 69.4 |

[1]Based on weight of raw coal; MBTU = $10^6$BTU
A cleaned by the gravity separation (sink-float process described in application no. 561,168
B cleaned using the agglomeration process described in application no. 933,845 using 1,1,2-trichloro-1,2,2-trifluoroethane as the agglomerant
C cleaned using the process of the present invention described above and 1,1,2-trichloro-1,2,2-trifluoroethane as an agglomerant As implied above, at least part of the particles existing at the end of the milling step contain both coal and pyritic sulfur. Because those particles tend to remain dispersed in the aqueous liquid, the increased reduction in pyritic sulfur afforded by the present process is accompanied by a reduction in yield as shown by the tabulated data. Nevertheless, the yield is still high enough to be very attractive from a commercial viewpoint; and it is much higher than the yield provided by any process capable of reducing pyritic sulfur to a level even an order of magnitude higher.

It is also important that, of the mineral matter retained with the produce coal, on the order of 40 weight percent will be calcium oxide in a typical application of my process. In the case of steaming coals, this is an advantage, not a disadvantage, because, as discussed above, the calcium ions precipitate sulfur liberated in the subsequent combustion of the coal, eliminating that sulfur as an atmospheric pollutant.

Furthermore, the calcium ions are intimately associated with the coal particles, thereby increasing the reactivity of the coal in hydrogasification and steam gasification processes in comparison to the reactivities obtained by the conventional process of impregnating the feedstock for such processes by using an aqueous solution of calcium oxide.

EXAMPLE II

To further demonstrate the effectiveness of my novel process in separating pyritic sulfur from coal and to show that it is generally applicable, the jar mill procedure above was used to clean Upper and Lower Freeport and Upper Kittanning coals. The data obtained from the test are tabulated in Table 2 in which weight percentages are again employed unless otherwise indicated.

TABLE 2

| | Lower Freeport (Penn.) | | Upper Freeport (Penn.) | | Lower Kittanning (Penn.) | |
|---|---|---|---|---|---|---|
| Seam Location Material: | Raw Coal | Coal Product | Raw Coal | Coal Product | Raw Coal | Coal Product |
| Ash % | 16.68 | 4.69 | 29.76 | 5.54 | 20.35 | 9.25 |
| Total Sulfur % | 2.87 | 1.13 | 2.30 | 1.19 | 4.68 | 1.77 |
| Weight Yield % | — | 83.8 | — | 68.2 | — | 83.0 |
| BTU Yield % | — | 98.2 | — | 96.4 | — | 95.7 |

TABLE 2-continued

| | Lower Freeport (Penn.) | | Upper Freeport (Penn.) | | Lower Kittanning (Penn.) | |
|---|---|---|---|---|---|---|
| Seam Location Material: | Raw Coal | Coal Product | Raw Coal | Coal Product | Raw Coal | Coal Product |
| % Red/n, Pyritic Sulfur | — | 92.0 | — | 82.0 | — | 94.0 |

Even though no attempt was made to optimize the process for the particular coals identified in this example, BTU yields averaged 97%; and the reductions in pyritic sulfur content were near the theoretical maximums for those particular coals.

EXAMPLE III

To show that the capabilities of calcium oxide are unique as a depressant for pyritic sulfur, a jar mill test as described above was made on Meigs No. 9 coal substituting three closely related compounds—hydrated barium, magnesium, and sodium oxides [$Ba(OH)_2$, $Mg(OH)_2$, and NaOH] for calcium oxide in amounts comparable to those in which I employ CaO. The results are tabulated below:

TABLE 3

Coal: Central Ohio Meigs No. 9
Fluorochlorocarbon Agglomerant: 1,1,a-trichloro-1,2,2-trifluoroethane

| CaO - related Compound Product Coal: | $Ba(OH)_2$ | CaO - related Compound Product Coal: | $Mg(OH)_2$ | CaO - related Compound Product Coal: | NaOH |
|---|---|---|---|---|---|
| Weight Yield % | 57.6 | Weight Yield % | 58.2 | Weight Yield % | 68.2 |
| Ash (wt %) | 4.68 | Ash (wt %) | 5.22 | Ash (wt %) | 3.76 |
| Total Sulfur (wt %) | 4.17 | Total Sulfur (wt %) | 4.49 | Total Sulfur (wt %) | 4.08 |

The weight percentage of total sulfur in the product coal was in all cases so high as to make it evident that no significant amount of pyritic sulfur had been separated from the coal. Consequently, no separate analysis was made for that constituent.

Aside from the inferior reduction in pyritic sulfur content, the use of barium, sodium, and magnesium oxides did not produce any significant improvement in weight yield or reduction in ash content.

EXAMPLE IV

In another test which shows the unexpected advantages of my novel process over those employing sodium sulfite as a pyrite depressant, that compound was employed in the stead of calcium oxide in the jar mill test on Meigs No. 9 coal essentially as taught in above-discussed patent to Stauter with sodium hydroxide being added in an amount which held the pH in the mill to approximately 6.

A fair reduction in ash content was obtained as was a fair yield. However, the goal of pyritic sulfur elimination was not achieved as evidenced by the 4.85 weight percent sulfur content of the product coal.

EXAMPLE V

In another test designed to show that calcium oxide can be employed to advantage with agglomerants which are not fluorochlorocarbons, the jar mill procedure was repeated on a 60 m×0 cut of the No. 9 Meigs coal using pentane, kerosene, and gasoline as agglomerants. In each instance the amount of calcium oxide added was sufficient to produce a calcium oxide-water system of the character described above in the mill.

The results are tabulated in Table 4 below.

TABLE 4

| Material: | Raw Coal | Product Coal A | Product Coal B | Product Coal C |
|---|---|---|---|---|
| Percentage by weight: | | | | |
| Ash | 22.27 | 2.40 | 5.21 | 6.90 |
| Pyritic Sulfur | 2.49 | 0.26 | 1.19 | 1.45 |
| Lb/MBTU: | | | | |
| Ash | 20.57 | 1.65 | 3.84 | 6.09 |
| Pyritic Sulfur | 2.30 | .18 | .87 | 1.28 |
| Percent Reduction/MBTU: | | | | |
| Ash | — | 92.0 | 81.3 | 70.4 |
| Pyritic Sulfur | — | 92.2 | 62.2 | 44.3 |
| BTU/Lb | 10,826 | 14,508 | 13,705 | 13,357 |
| BTU Yield | — | 55.5 | 81.9 | 76.6 |

A cleaned using pentane as the agglomerant
B cleaned using kerosene as the agglomerant
C cleaned using a regular grade gasoline as the agglomerant A comparison of the data in the Product Coal A column of Table 4 and the Product Coal A and C columns of Table 1 shows that excellent results were obtained using the combination of pentane as an agglomerant and calcium oxide as a pyritic sulfur expeller-rejector, both in terms of pyritic sulfur reduction and BTU content of the product coal. While less outstanding results were obtained in the other two tests, they nevertheless show what they were intended to confirm—that the removal of pyritic sulfur from coal with calcium oxide in accord with the principles of the present invention is to at least a large extent not dependent upon the use of a particular agglomerant.

Furthermore, it is pointed out that no attempt was made to optimize the results which can be obtained when kerosene and gasoline are employed in combination with calcium oxide in my process. Such efforts would unquestionably produce results superior to those reported in Table 4.

EXAMPLE VI

As discussed above, the use of CaO as a pH modifier in coal cleaning processes has heretofore been proposed, the CaO being used to keep the pH of the system in the range of 7–10. At a pH in that range, the aqueous phase of the solution is not saturated with CaO; and the elimination of pyritic sulfur afforded by my novel process is not obtained.

This was demonstrated by a test as described in Example 1 except that 15 wt % of raw coal was slurried with 75.8 wt % of water, 9 wt % of 1,1,2-trichloro,-1,2,2,trifluoroethane, and 0.03 wt % of hydrated lime (below saturation, pH 7–10) in Case 1 and, in Case 2, with 0.2 wt % of hydrated lime (in excess of saturation, pH greater than 11). All percentages are based on the whole slurry mixture.

The results are shown in Table 5.

TABLE 5

| Material Product By Weight | Raw Coal | Product Coal Case 1 (below saturation) | Product Coal Case 2 (saturated with excess CaO |
|---|---|---|---|
| Ash | 36.41 | 9.83 | 5.09 |
| Pyritic Sulfur | 0.99 | 0.64 | 0.00 |
| BTU Yield | — | 95 | 95 |

EXAMPLE VII

That milling in the presence of a water system saturated with, and containing an excess of, calcium oxide is essential to the levels of pyritic sulfur rejection I obtain was demonstrated by a test conducted on an Upper Freeport coal. The object of the test was to find the minimum amount of milling (energy expenditure) that could achieve a product coal with 0.6 lbs. sulfur/M-BTU (in this case, 0.89 wt % sulfur), not to achieve a maximum removal of pyritic sulfur from the coal. The procedure employed was essentially that described in Example I except that the feed coal had a size distribution of 100 mesh×0, and the milling time was reduced to 15 minutes. The results are shown in Table 6.

TABLE 6

| Material Percentage By Weight | Raw Coal | Product Coal, No Milling | Product Coal, With Milling |
|---|---|---|---|
| Ash | 22.03 | 9.63 | 6.38 |
| Pyritic Sulfur | 0.81 | 0.81 | 0.4 |
| Total Sulfur | 1.15 | 1.15 | 0.89 |
| BTU Yield | — | 95 | 95 |

The data show that even a less than optimum milling procedure from the viewpoint of maximum pyrite removal produced results materially superior to those obtained in the "No Milling" test in which only a trace of pyritic sulfur was removed.

The invention may be embodied in other specific forms without departing from the spirit or essential characteristics thereof. The present embodiments are therefore to be considered in all respects as illustrative and not restrictive, the scope of the invention being indicated by the appeded claims rather than by the foregoing description; and all changes which come within the meaning and range of equivalency of the claims are therefore intended to be embraced therein.

What is claimed and desired to be secured by Letters Patent is:

1. A process for recovering coal with a minimum pyrite content from an aqueous slurry containing raw coal, said process comprising the steps of: maintaining an agglomerant in said slurry; maintaining calcium oxide in the slurry in an amount exceeding that sufficient to form a saturated solution with the aqueous phase of the slurry; concomitantly comminuting the raw coal in said slurry to effect a separation of the coal from pyritic sulfur and other mineral matter associated therewith and to expose fresh surfaces on the coal particles; coalescing the separated coal particles into agglomerates while effecting a dispersion of the pyritic sulfur and other mineral matter in the aqueous liquid carrier portion of the slurry; and recovering the agglomerates from the slurry.

2. A process as defined in claim 1 in which the agglomerant comprises a fluorochloro derivative of methane or ethane.

3. A process as defined in claim 1 in which the agglomerant comprises a petroleum distillate or solvent; a nitrobenzene; kerosene; a lubricating, fuel, or residual oil; or a chlorinated biphenyl.

4. A process as defined in claim 1 in which the raw coal, agglomerant, calcium oxide, and water are continuously supplied to the apparatus in which the process is carried out and in which the products of the process are continuously removed therefrom, whereby the coal recovery process is carried out in a continuous as opposed to batch-type fashion.

5. A process for recovering coal with a minimum pyrite content from an aqueous slurry containing raw coal, said process comprising the steps of: maintaining an agglomerant selected from the group consisting of dichlorofluoromethane; trichlorofluoro-methane; 1,1,2,2-tetrachloro-1,2-difluoroethane; 1,1,2-trichloro-1,2,2-trifluoroethane; 1,1-dichloro-1,2,2,2-tetrafluoroethane; 1,-chloro-2,2,2-trifluoroethane; 1,1-dichloro-2,2,2-trifluoroethane; 1-chloro-2-fluoroethane and mixtures of the foregoing in said slurry; maintaining calcium oxide in the slurry; comminuting the raw coal in said slurry to effect a separation of the coal from pyritic sulfur and other mineral matter associated therewith and to expose fresh surfaces on the coal particles; coalescing the separated coal particles into agglomerates while effecting a dispersion of the pyritic sulfur and other mineral matter in the aqueous liquid carrier portion of the slurry; and recovering the agglomerates from the slurry.

6. A process as defined in claim 5 in which the raw coal, agglomerant, calcium oxide, and water are continuously supplied to the apparatus in which the process is carried out and in which the products of the process are continuously removed therefrom, whereby the coal recovery process is carried out in a continuous as opposed to batch-type fashion.

7. A process as defined in claim 5 in which the calcium oxide is maintained in said slurry in an amount exceeding that sufficient to form a saturated solution with the aqueous portion of the slurry.

8. A process for dissociating coal from a composite in which pyritic sulfur and other mineral matter is associated therewith and for recovering said coal in agglomerated form, said process comprising the steps of: forming a slurry of said composite in an aqueous carrier with respect to which said pyritic sulfur and mineral matter is hydrophilic; maintaining a fluorocarbon with respect to which said coal particles are hydrophobic in said slurry in an amount sufficient that agglomeration of the coal can be effected; comminuting the particles of composite while in said slurry to separate the pyritic sulfur and other mineral matter from the coal and to generate coal particles having freshly exposed surfaces in a controlled environment; mechanically effecting the coalescence of the coal particles into product coal agglomerates and the ejection of pyritic sulfur, other mineral matter, and water from the agglomerates into dispersion in said aqueous carrier; maintaining calcium oxide in said slurry in an amount effective to promote the rejection of pyritic sulfur from said agglomerates; and recovering said product coal agglomerates from said slurry.

9. A process as defined in claim 8 in which the fluorocarbon is selected from the group consisting of dichlorofluoromethane; trichlorofluoromethane; 1,1,2,2-tetrachloro-1,2-difluoroethane; 1,1,2-trichloro-1,2,2-trifluoroethane; 1,1-dichloro-1,2,2,2-tetrafluoroethane; 1-chloro-2,2,2-trifluoroethane; 1,1-dichloro-2,2,2-trifluoroethane; 1-chloro-2-fluoroethane and mixtures of the foregoing.

10. A process as defined in claim 8 in which the raw coal, agglomerant, calcium oxide, and water are continuously supplied to the apparatus in which the process is carried out and in which the products of the process are continuously removed therefrom, whereby the coal recovery process is carried out in a continuous as opposed to batch-type fashion.

11. A process as defined in claim 8 in which, at least once during the course of the process cycle, the aqueous liquid and material dispersed therein is removed and replaced with unburdened aqueous liquid.

12. A process as defined in claim 8 in which carrier burdened with pyritic sulfur and mineral matter is continuously removed from the slurry and replaced with unburdened aqueous liquid.

13. A process as defined in claim 8 in which the calcium oxide is dosed to the slurry.

14. A process as defined in claim 8 in which the calcium oxide is maintained in the slurry in an amount exceeding that sufficient to form a saturated solution with the aqueous portion of the slurry.

* * * * *

UNITED STATES PATENT AND TRADEMARK OFFICE

CERTIFICATE OF CORRECTION

PATENT NO. : 4,248,698
DATED : Feb. 3, 1981
INVENTOR(S) : Doug V. Keller, Jr.

It is certified that error appears in the above—identified patent and that said Letters Patent is hereby corrected as shown below:

Col. 1, line 46, cancel "to generate" second occurence.

Col. 1, line 67, change "advantageous" to --disadvantageous--.
Col. 2, line 46, change "howver" to --however--.
Col. 8, line 44, change "chamical" to --chemical--.
Col. 8, Table 1, change "10.707" to --10,707--, change "13.173" to --13,173--, change "13.372" to --13,372--, change "13.984" to --13,984--.
Col. 9, line 24, change "produce" to --product--.
Table 3, second line after title, change "1,1,a-trichloro-1,2,2-trifluoroethane" to --1,1,2-trichloro-1,2,2-trifluoroethane--.
Col. 13, claim 5, line 10, omit the "comma", first occurence.

Signed and Sealed this

*Fifteenth* Day of *June 1982*

[SEAL]

*Attest:*

GERALD J. MOSSINGHOFF

*Attesting Officer* *Commissioner of Patents and Trademarks*